United States Patent [19]

Fisher et al.

[11] Patent Number: 4,743,161

[45] Date of Patent: May 10, 1988

[54] COMPRESSORS

[75] Inventors: Frank B. Fisher, Meltham; Paul J. Langdon, Holmfirth, both of England

[73] Assignee: Holset Engineering Company Limited, Turnbridge, England

[21] Appl. No.: 945,713

[22] Filed: Dec. 23, 1986

[30] Foreign Application Priority Data

Dec. 24, 1985 [GB] United Kingdom ..... 8531739
Jan. 15, 1986 [GB] United Kingdom ..... 8600884

[51] Int. Cl.[4] ..... F04D 29/42

[52] U.S. Cl. ..... 415/53 R; 415/206; 415/DIG. 1

[58] Field of Search ..... 415/11, 53 R, DIG. 1, 415/119, 144, 206, 213 R, 219 C, 116

[56] References Cited

U.S. PATENT DOCUMENTS 2,832,292 4/1958 Edwards ..... 415/53 R X
3,217,655 11/1965 Sercy et al. ..... 415/116
3,462,071 8/1969 Garve ..... 415/116
3,730,639 5/1973 Moore et al. ..... 415/DIG. 1 X
3,901,620 8/1975 Boyce ..... 415/53 R X
4,248,566 2/1981 Chapman et al. ..... 415/DIG. 1 X
4,479,755 10/1984 Skoe ..... 415/DIG. 1 X

FOREIGN PATENT DOCUMENTS 1043168 9/1966 United Kingdom ..... 415/DIG. 1

*Primary Examiner*—Robert E. Garrett
*Assistant Examiner*—Joseph M. Pitko
*Attorney, Agent, or Firm*—Gary M. Gron; Robert T. Ruff

[57] ABSTRACT

The disclosure illustrates a range improvement feature for a compressor wheel in which a chamber adjacent the inlet is separated from the outer periphery of the impeller wheel vanes by a wall through which communication is established between the chamber and the impeller wheel. Communication is provided by either an annular slot or a series of radial holes. The feature may be used on single stage or multistage compressors. The area of the communication is such that at high rpm, and/or high flow, flow is from the chamber inward and at lower flows the flow is from the impeller wheel outward. This bidirectional flow improves the range over which the compressor may operate without encountering surge.

10 Claims, 4 Drawing Sheets

COMPRESSORS

The present invention relates to compressors e.g. axial and centrifugal compressors and multistage versions thereof.

Compressors normally comprise an impeller wheel, carrying a plurality of blades or vanes, and mounted on an axis for rotation within a housing. Rotation of this impeller wheel causes gas (usually air) to be drawn into the impeller wheel and to be discharged to a passage or passages for transferring the compressed gas to its destination. In the case of a centrifugal compressor the gas is discharged centrifugally and in the case of an axial compressor the gas is discharged axially. In the case of a turbine driven compressor in a turbocharger, the compressor impeller wheel and the turbine wheel are mounted on a common axis so that rotation of the turbine wheel causes rotation of the impeller wheel.

It has been proposed in U.S. Pat. No. 4,248,566 to form an annular control slot in the stationary housing so as to allow an inflow of gas from outside the housing to the impeller wheel under high r.p.m. conditions of compressor operation and to allow gas flow to bleed from the impeller wheel to the exterior of the housing when the wheel is operating at lower r.p.m. whereby to flow stabilize the impeller wheel at part r.p.m. operation.

Such an arrangement however provides stable operation over only a relatively narrow range of engine r.p.m. and there is now a requirement to increase the engine r.p.m. over which compressors can operate in stable manner. This is achieved in accordance with the present invention by providing communication between the chamber in which the compressor wheel rotates and an annular chamber formed in the gas intake to the impeller wheel and preferably at least partly surrounding the impeller wheel. The air is thus not bled to the exterior of the housing, and thus atmosphere, nor drawn in from atmosphere separately from the normal gas intake to the compressor (as in U.S. Pat. No. 4,248,566), but is bled back to the normal intake or is drawn from the normal intake.

Accordingly to the present invention there is provided a compressor comprising an impeller wheel including a plurality of vanes or blades each of which includes a leading edge, a trailing edge and an outer free edge. The wheel is mounted for rotation within a housing, the housing including an inner wall and an outer wall. At least part of the inner surface of the inner wall is in close proximity to, and of similar contour to, the outer free edges of the blades or vanes. The inner wall forms an inlet to the impeller wheel in a region adjacent the leading edges of the blades or vanes, the outer wall forming a gas intake surrounding the inner wall and extending in an axial direction. A chamber, preferably an annular chamber, is formed between said inner and outer walls in a region preferably at least partly surrounding said blades or vanes. Communication is provided through the inner wall between said chamber and the inner surface of said inner wall whereby gas may pass in both directions between the area swept by the vanes or blades and the chamber.

The invention will now be further described by way of example with reference to the accompanying drawings in which.

Figure 1:
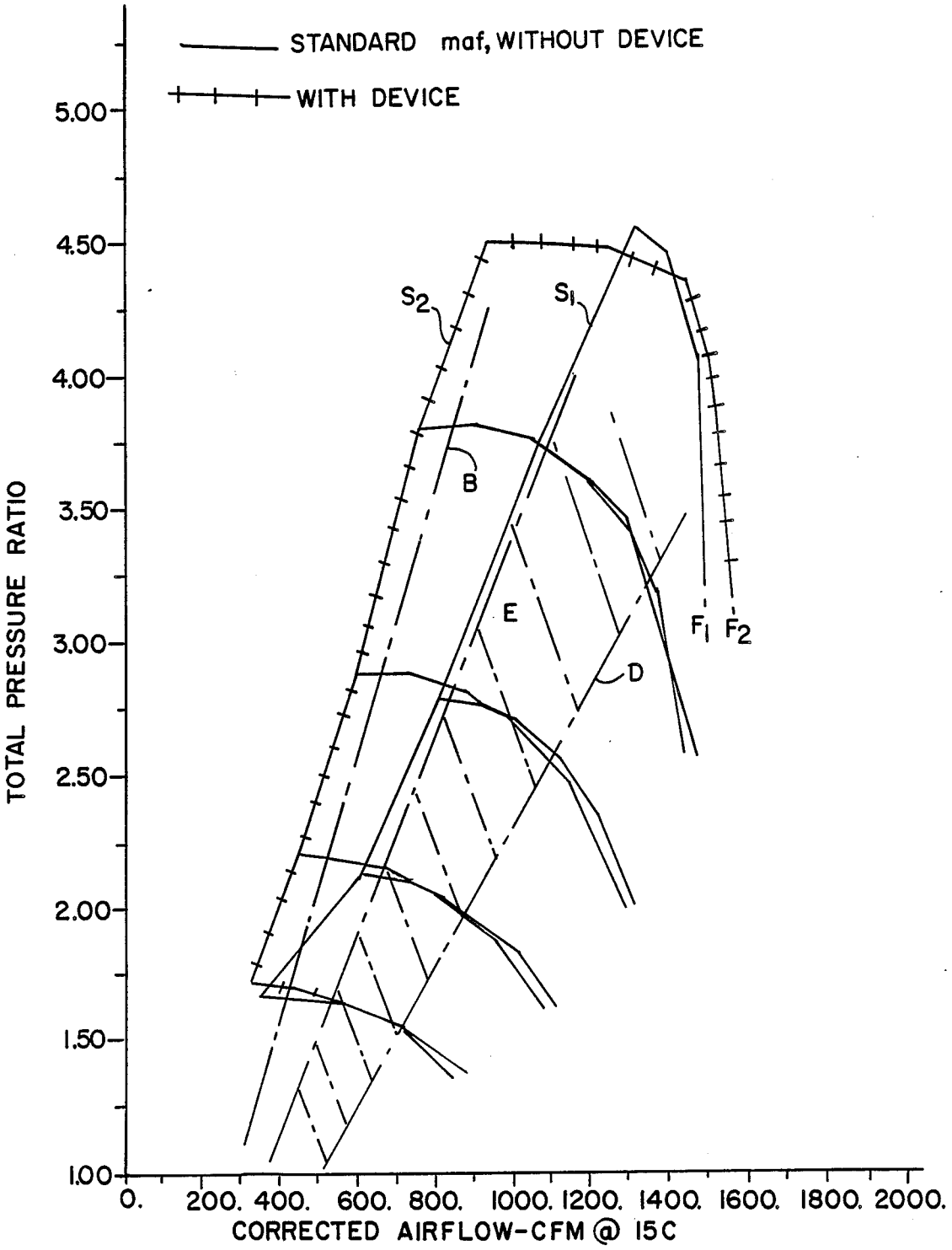
FIG. 1 is a graph of pressure against mass flow in a compressor.

Referring to FIG. 1 there is shown a graph plotting pressure against mass flow in a single stage centrifugal compressor. The area between the lines D and E which is shown by shading, indicates a typical engine r.p.m. range over which a compressor not incorporating the present invention will operate. There is however a requirement to increase the engine r.p.m. range to cover an area between the lines D and B on the graph and it is therefore necessary to alter the characteristics of the compressor in order to move the surge line from the line marked $S_1$ to the line marked $5_2$. This performance can be achieved by use of the present invention. Similar results can be achieved with an axial compressor.

Figure 2:
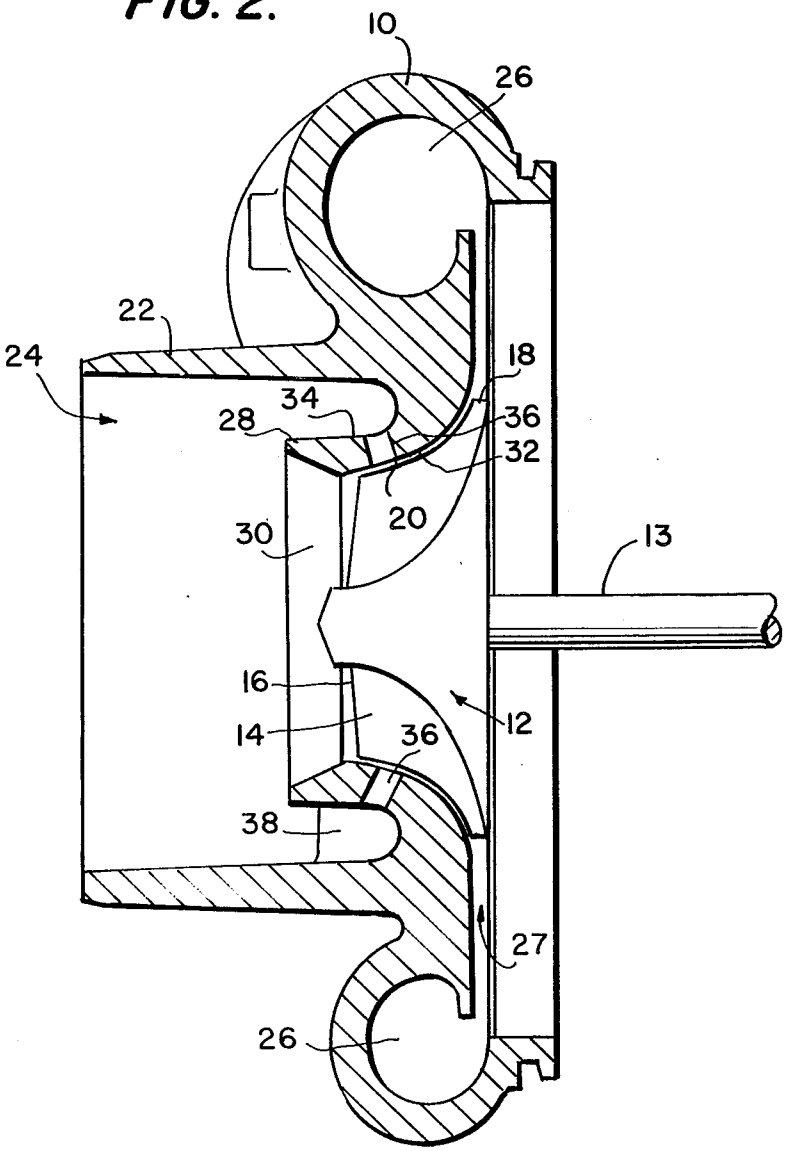
FIG. 2 is a cross-section through part of a compressor in accordance with one embodiment of the present invention.

Referring now to FIG. 2, there is shown a cross-section view of a single stage centrifugal compressor comprising a housing 10 having an impeller wheel 12 mounted on shaft 13 which is journalled for rotation.

The wheel 12 includes a plurality of blades or vanes 14, each including a leading edge 16, a trailing edge 18 and an outer free edge 20. The housing 10 includes an outer wall 22, defining an intake 24 for gas such as air, and a passageway or volute 26 for carrying compressed gas from an annular diffuser 27 adjacent the impeller wheel 12 to its destination e.g. the inlet manifold of an internal combustion engine. An inner wall 28 defines an inlet 30 to the impeller and an inner surface 32 of the inner wall 28 is in close proximity to and of extremely similar contour to, the outer free edges 20 of the blades or vanes 14. The inner wall 28 extends a short distance upstream from the blades 14 of the impeller wheel 12 to form an annular space or chamber 34 between the walls 22 and 28. The annular chamber 34 partly surrounds the impeller wheel 12. An annular slot 36 is formed in the wall 28 and a series of webs 38 serve to bridge the annular slot 36 at intervals round its circumference. The slot 36 is located along the meridional length at a point just upstream of the point of minimum pressure. This point is preferably some 65 to 75% of the distance from the leading edges 16 of the blades or vanes 14 to the point of minimum pressure and is typically 22 to 34% of the impeller blade length. In the arrangement shown in FIG. 1 the slot is located some 73% of the distance from the leading edge 16 of the blades 14 to the point of minimum pressure and is 30% of the length of the impeller blades 14 from the leading edges 16 of the blades.

The total area of the slot is normally of the order of 13 to 23% of the inducer annular area. In the arrangement shown the total area of the slot is 15% of the inducer annular area (flow area of inlet 30 minus area of the hub of wheel 12).

In operation the impeller wheel 12 is rotated e.g. by a turbine wheel (not shown) attached to the common shaft 13 with the compressor wheel and this causes air to be drawn into the impeller wheel 12 through intake 24 and inlet 30. The air is compressed by the impeller wheel 12 and is then fed to its ultimate destination via diffuser 21 and passageway or volute 26. The pressure in the chamber 34 is normally lower than atmospheric pressure and during high flow and high r.p.m. operation the pressure in the area swept by the impeller wheel is less than in the chamber 34 and thus air flows inward through the slot 36 from the chamber 34 to the impeller wheel 12 thereby increasing the amount of air reaching the impeller wheel, and increasing its maximum flow capacity. As the flow through the impeller wheel 12 drops, or as r.p.m. of the impeller wheel drops, so the amount of air drawn into the wheel 16 through the slot 36 decreases until equilibrium is reached. Further drop in impeller wheel flow or r.p.m. results in the pressure in the area swept by the impeller wheel being greater than in the chamber 34 and thus air flows outward through the slot 36 from the impeller 12 to the chamber 34. The air bled out of the impeller wheel 12 is recirculated to the air intake and thereby back to the inlet 30. Increase in flow or r.p.m. of the impeller wheel causes the reverse to happen, i.e., a decrease in the amount of air bled from the impeller wheel followed by equilibrium followed by air being drawn into the impeller wheel 12 via the slot 36. This particular arrangement results in improved stability of the compressor at all speeds and a shift in the the characteristics of the compressor. For example, the surge line is moved as shown in FIG. 1 from $S_1$ to $S_2$ and the maximum flow capacity is moved from line $F_1$ to $F_2$ as shown in FIG. 1. The compressor can thus be matched to engines with a wider speed range than can conventional compressors.

Figure 3:
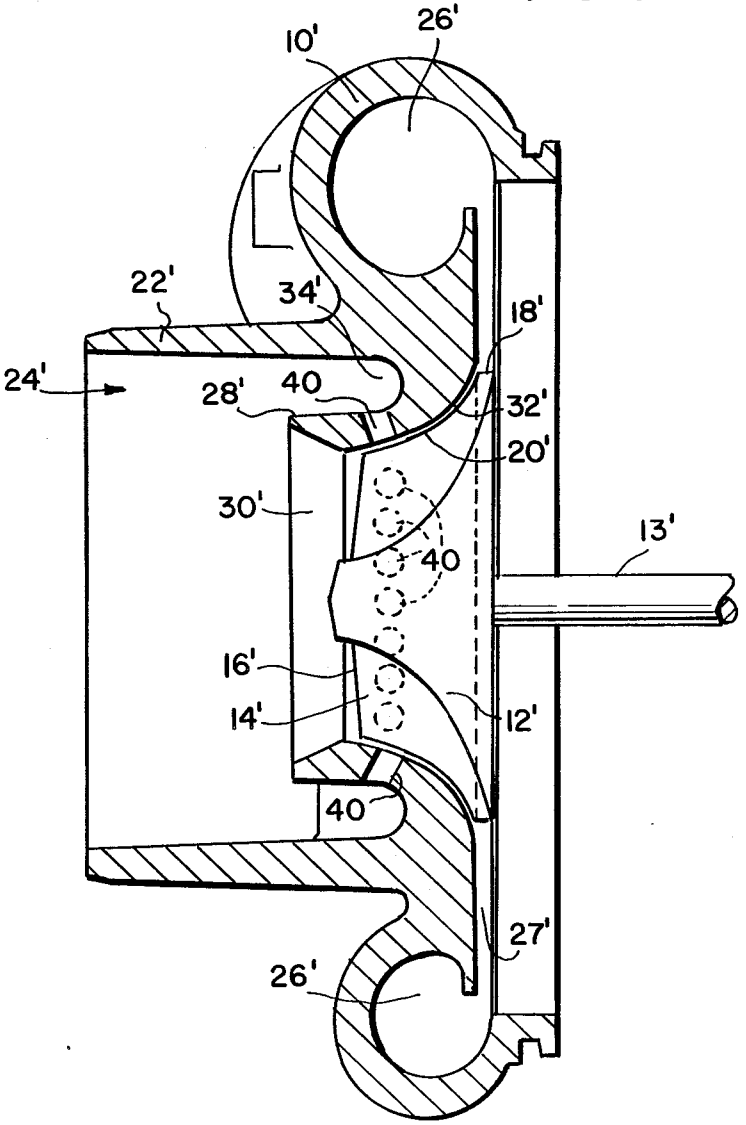
FIG. 3 is a cross-section through part of a compressor in accordance with another embodiment of the present invention.

Referring now to FIG. 3 there is shown an alternative embodiment in which the slot 36 is replaced by a series of holes 40 and in which like elements are designated by like numbers with a prime. In this case there is of course no need for the webs 38 of the arrangement of FIG. 2. The positioning of the holes 40 along the meridional length and area of the holes at the inner surface 32 is similar to the positioning and area of the slot 36 in FIG. 2. The number of holes should be arranged so that it is not equal to, nor a multiple of, nor a factor of the number of blades on the compressor wheel. If the number of holes is a multiple of or a factor of the number of blades then vibratory excitation can be induced. In the arrangement shown in FIG. 3 the number of holes 40 is 29 and the number of blades is 16.

Figure 4:
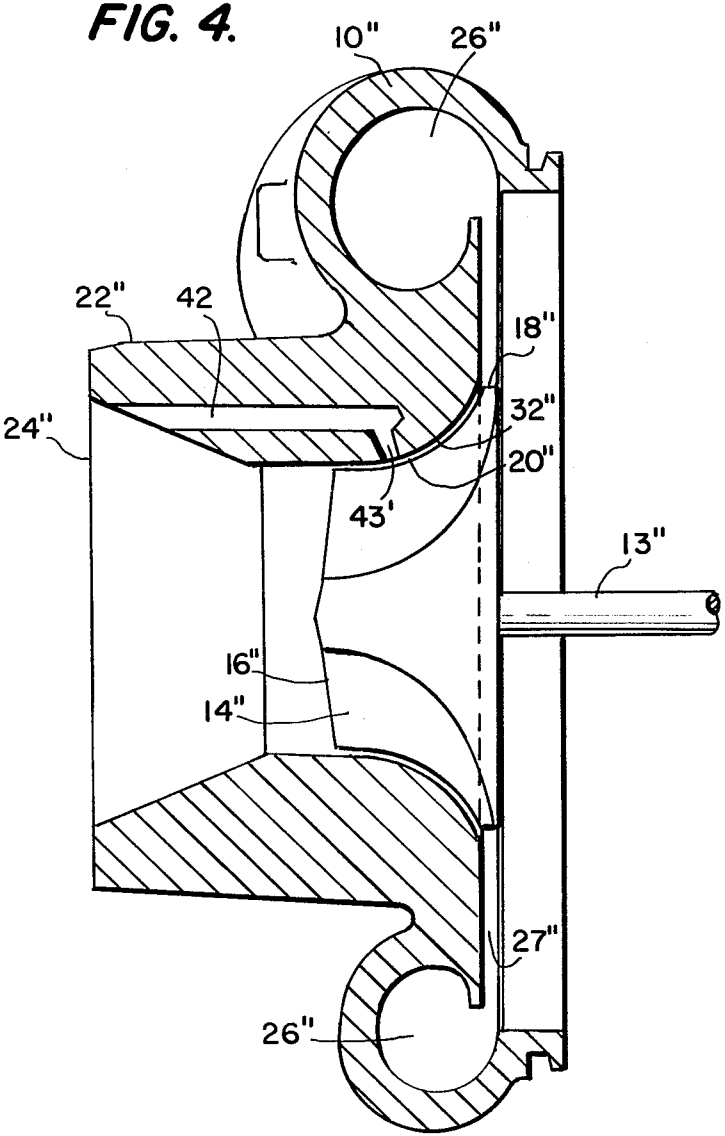
FIG. 4 is a cross-section through part of a compressor in accordance with a further embodiment of the present invention.

Referring now to FIG. 4 there is shown a further alternative embodiment of the invention in which the flow communication function of chamber 34 is provided by a series of blind bores 42 (only one of which is shown) formed in the wall 22" of the housing 10". As shown in FIG. 4 each bore 42 is connected to a hole 43 extending inward to surface 32". Alternately the bores 42 may extend to an annular slot similar to slot 36 in FIG. 2.

Figure 5:
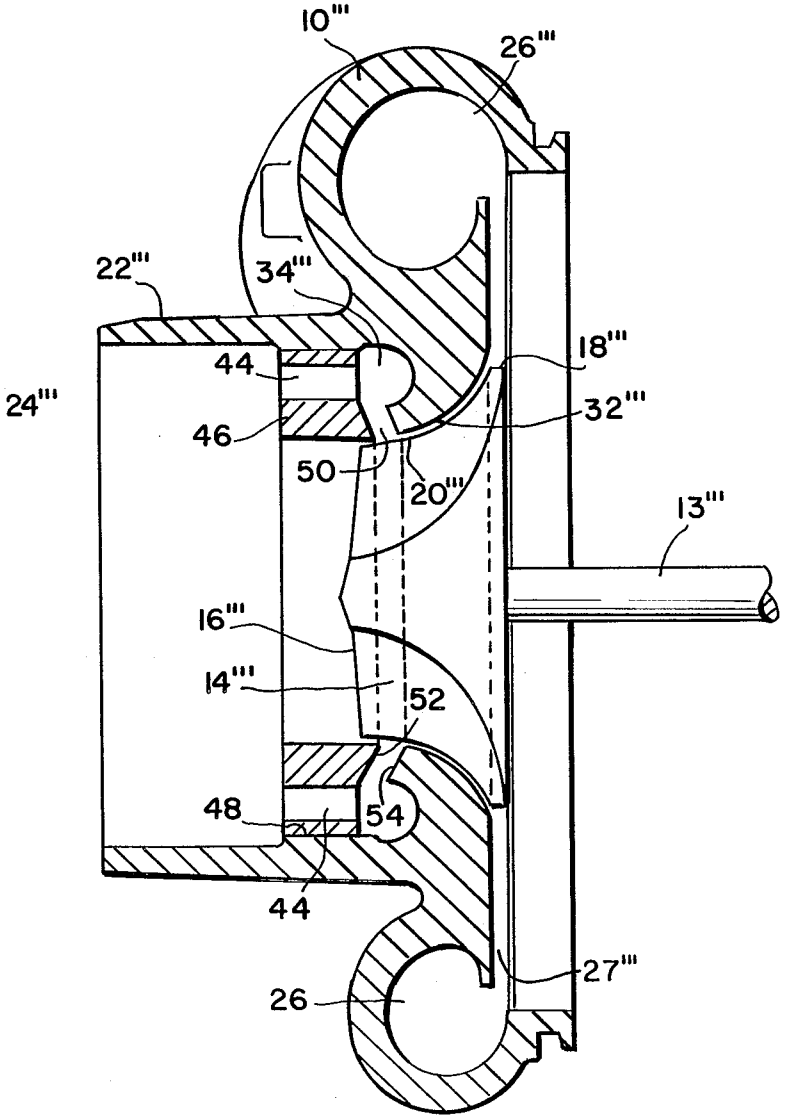
FIG. 5 is a cross-section through part of a compressor in accordance with yet a further embodiment of the present invention.

Referring now to FIG. 5 there is shown an arrangement in which the chamber 34 is formed partly in the housing 10 and partly by series of holes 44 formed in a ring 46 which may be aluminum or plastic and press fit or otherwise retained within a bore 48 formed in outer wall 22". The chamber 34, as in other embodiments, communicates with the impeller wheel 12 via a series of holes or a slot 50 formed between upstream axial end face 52 of ring 46 and an annular end wall 54 of housing 10.

Figure 6:
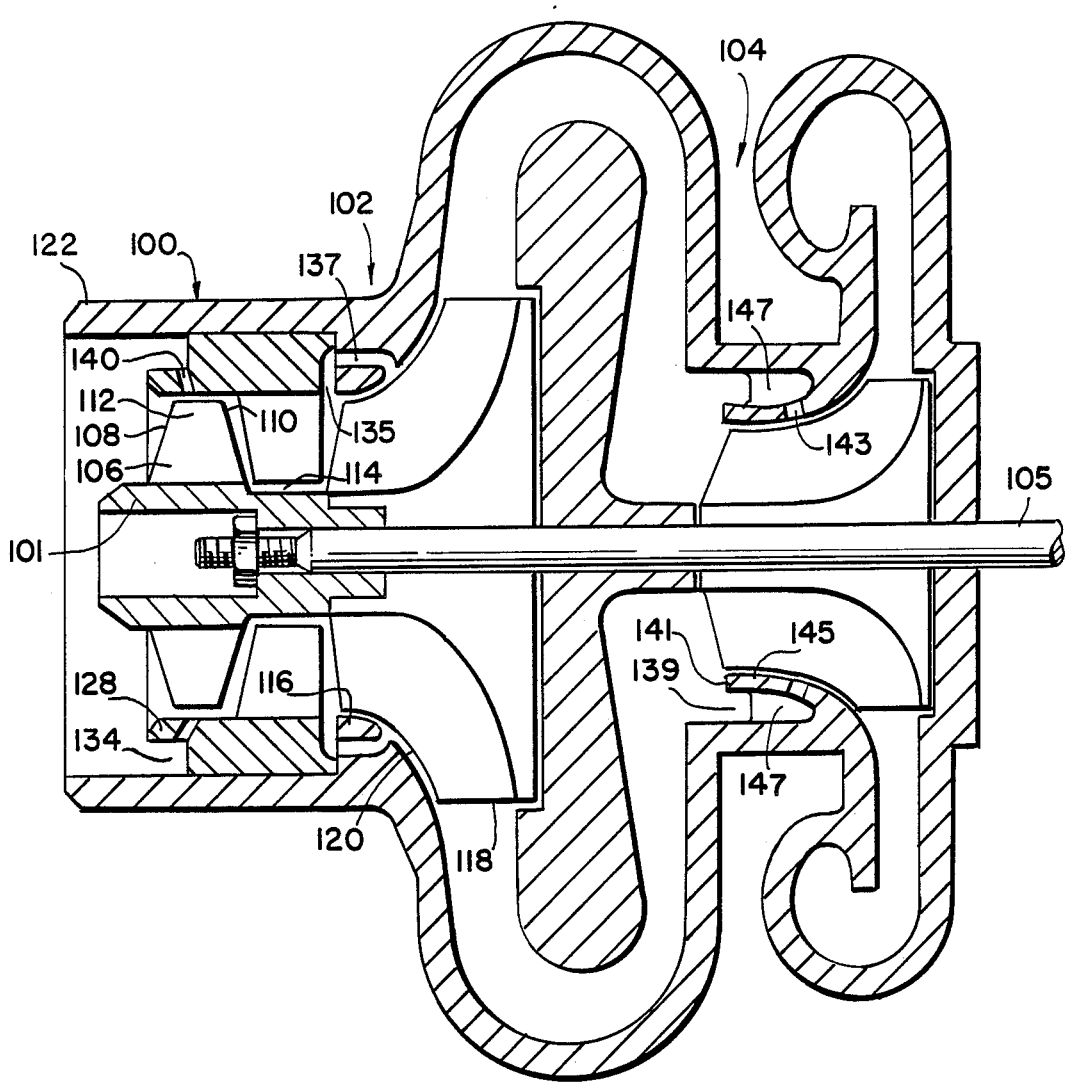
FIG. 6 is a cross-section through a multistage compressor in accordance with the present invention.

Referring now to FIG. 6, there is shown a multistage compressor, comprising an axial compressor 100, and two centrifugal compressors 102 and 104 arranged in series on shaft 105 suitably journalled for rotation. Axial compressor 100 includes an impeller wheel 101 having a series of vanes or blades 106 each of which includes a leading edge 108, a trailing edge 110 and an outer free edge 112. Air compressed by compressor 100 is fed via axial outlet 114 to the inlet 116 of centrifugal compressor 102. Axial compressor 100 includes inner and outer walls 28 and 22 respectively defining an annular space or chamber 134 as in the arrangement of FIGS. 2 and 3. In addition, a slot, or a series of holes 140 (as shown), is provided in wall 128 as in the device of FIG. 2. Operation is similar to that of the device of FIGS. 2 and 3 with air bleeding from the impeller wheel 101 to the chamber 134 near surge and with air being drawn from the chamber 134 to the impeller 101 at high flow and high r.p.m.

Compressor 102 has an annular chamber 135 adjacent inlet 116. A series of passageways 137 extend from the perifery of the impeller for compressor 102 to chamber 135.

Similarly compressor 104 has a chamber 139 adjacent its inlet 141. In this case an annular slot 143 extends through an annular wall 145 separating chamber 139 from the perifery of the compressor impeller. A series of webs 147 mount wall 145 with respect to the housing.

The compressor of the present invention is especially useful when forming part of a turbocharger for an internal combustion engine particularly where an air cleaner is provided upstream of the air intake to the compressor. This latter preference is because the air cleaner results in the air pressure in the intake being depressed below atmospheric to a greater extent than without an air cleaner and thus results in even better operation of the compressor of the invention due to the pressure differential between the two ends of the slot or holes at low flow (i.e. near surge) being greater.

The respective areas of the passages amd their position relative to the impeller are as described in connection with FIG. 2 above.

Although several preferred embodiments of the present invention have been described, it should be apparent to those skilled in the art that it may be practiced in other forms without departing from its spirit and scope.

What is claimed as novel and desired to be secured by Letters Patent of the United States is:

1. A compressor for compressing gas, said compressor comprising an impeller wheel including a plurality of vanes each of which includes a leading edge, a trailing edge and an outer free edge, said wheel being mounted for rotation within a housing and operable between choked flow and a surge line, the housing including an inner wall and an outer wall, at least part of the inner surface of the inner wall being in close proximity to, and of similar contour to, the outer free edges of the vanes, and forming an inlet to said impeller wheel in a region adjacent the leading edges of said vanes, said outer wall forming a gas intake surrounding said inner wall and extending in an axial direction, means for forming a chamber between said inner and outer walls in a region at least partly surrounding said vanes and connected to said gas intake, and means for providing a bidirectional flowpath through said inner wall between said chamber and the inner surface of said inner wall whereby gas may pass in both directions between the area swept by the vanes and the chamber via the flowpath means to broaden the range of operation between choked flow and the surge line for said compressor.

2. A compressor as in claim 1, in which the flowpath means between the chamber and the inner surface of the inner wall is defined by an annular slot extending around and formed in the inner wall, said compressor further comprising and bridging a plurality of connecting webs bridging the slot.

3. A compressor as in claim 1 in which the flowpath means is defined by a series of holes formed through the inner wall between the chamber and the inner surface of the inner wall.

4. A compressor as claimed in claim 1, in which the number of holes is not equal to, and a multiple of, and a factor of, the number of vanes on the impeller wheel.

5. A compressor as in claim 4, having from 29 to 43 holes.

6. A compressor as in claim 1, in which the total cross sectional flow area of the flowpath means at the inner surface of the inner wall is from 13 to 23% of the inducer annular area.

7. A compressor as in claim 1, in which the compressor is a centrifugal compressor and the flowpath means is located at a point along the meridional length of the free edge of the vanes just upstream of the point of minimum pressure.

8. A compressor as in claim 7, in which the flowpath means is located at a point from 65 to 75% of the distance from the leading edge of the blades to the minimum pressure point.

9. A compressor as in claim 1, in which the compressor is an axial compressor and the flowpath means is located from 15 to 25% along the length of the outer free edges of the vanes from the leading edges.

10. A compressor as in claim 1, further comprising at least a second compressor connected in series flow relationship to said first compressor and having a second impeller wheel mounted for joint rotation with the first impeller wheel, said second compressor having a housing including an inner wall and an outer wall, at least part of the inner surface of the inner wall being in close proximity to, and of similar contour to, the outer free edges of the vanes of said second impeller wheel in a region adjacent the leading edges of said vanes, said outer wall forming a gas intake surrounding said inner wall and extending in an axial direction toward the outlet of said first compressor, a chamber formed between said inner and outer walls in a region at least partly surrounding said vanes, and means for providing a flowpath through said inner wall between said chamber and the inner surface of said inner wall whereby gas may pass in both directions between the area swept by the vanes of the second impeller wheel and the chamber.

* * * * *